US006338189B1

(12) United States Patent
Xu et al.

(10) Patent No.: US 6,338,189 B1
(45) Date of Patent: Jan. 15, 2002

(54) METHOD AND APPARATUS FOR EXPANSION FORMING A WORKPIECE USING AN EXTERNAL DEFORMABLE SUPPORTING FIXTURE

(75) Inventors: Raymond Ruiwen Xu, Carmel; Stephen N. Hammond, Brownsburg; Jacque B. Kennedy; Randolph C. Helmink, both of Indianapolis; Robert A. Testin, Zionsville, all of IN (US)

(73) Assignee: Allison Engine Company, Inc., Indianapolis, IN (US)

( * ) Notice: Subject to any disclaimer, the term of this patent is extended or adjusted under 35 U.S.C. 154(b) by 0 days.

(21) Appl. No.: 09/414,267

(22) Filed: Oct. 7, 1999

(51) Int. Cl.[7] ..... B23P 17/00
(52) U.S. Cl. ..... 29/423; 29/446; 72/353.4
(58) Field of Search ..... 29/423, 446, 894.325, 29/222; 72/353.4, 353.6, 393; 228/199

(56) References Cited

U.S. PATENT DOCUMENTS

| | | | | | |
|---|---|---|---|---|---|
| 182,724 | A | | 9/1876 | Tyler et al. | |
| 373,855 | A | | 9/1887 | Rung | |
| 465,836 | A | | 12/1891 | Crees | |
| 756,832 | A | * | 4/1904 | Cleveland | |
| 938,816 | A | | 11/1909 | Bourgeois | |
| 1,041,406 | A | | 10/1912 | Bauroth | |
| 2,175,746 | A | | 10/1939 | Darling | |
| 3,222,910 | A | * | 12/1965 | Roper | |
| 3,461,699 | A | | 8/1969 | Roth | |
| 3,581,546 | A | | 6/1971 | Ragettli | |
| 3,706,120 | A | * | 12/1972 | Bulgrin | |
| 4,135,553 | A | * | 1/1979 | Evans et al. | 138/141 |
| 4,535,619 | A | * | 8/1985 | Gargrave | |
| 4,593,448 | A | * | 6/1986 | Ferrari | 29/523 |
| 4,599,123 | A | * | 7/1986 | Christensson | |
| 4,641,407 | A | | 2/1987 | Blevins et al. | |
| 4,777,717 | A | * | 10/1988 | Okumoto et al. | 29/596 |
| 4,987,763 | A | | 1/1991 | Kistner et al. | |
| 5,275,033 | A | | 1/1994 | Riviere | |
| 5,433,100 | A | * | 7/1995 | Easterbrook et al. | 72/391.2 |
| 5,595,086 | A | * | 1/1997 | Scherf | 72/353.4 |
| 5,704,244 | A | | 1/1998 | Halasz et al. | |
| 6,154,946 | A | * | 12/2000 | Kapp | 29/447 |

* cited by examiner

*Primary Examiner*—S. Thomas Hughes
*Assistant Examiner*—Steven A Blount
(74) *Attorney, Agent, or Firm*—Woodard, Emhardt, Naughton, Moriarty & McNett

(57) ABSTRACT

The present invention generally relates to an external cylindrical or conic section shaped fixture which is tightly fit around the same shaped workpiece prior to expansion forming to a final dimension. During expansion forming, the external fixture is also deformed and is therefore designed for one-time use. The external cylindrical or conic section shaped fixture of the present invention is particularly useful for expansion forming of workpieces which contain brazed lap joints. The external fixture restrains, out-of-plane joint rotation and reduces the stress concentrations existing near the lap joints. Additionally, the external fixture provides additional load carrying capability to allow better load distribution during expansion forming. No change is required to the expansion forming machinery or the inner expander dies (jaws) with use of the present invention. Because the external fixture fits tightly over the workpiece, applying a compressive force when the inner expander jaws expand during the forming process, the bending moment on the brazed lap joints is significantly reduced.

17 Claims, 4 Drawing Sheets

METHOD AND APPARATUS FOR EXPANSION FORMING A WORKPIECE USING AN EXTERNAL DEFORMABLE SUPPORTING FIXTURE

TECHNICAL FIELD OF THE INVENTION

The present invention generally relates to methods and apparatuses for expansion forming and, more specifically, to a method and apparatus for expansion forming a workpiece using an external deformable supporting fixture.

BACKGROUND OF THE INVENTION

Oxide-dispersion-strengthened (ODS) high temperature alloys offer combinations of high-temperature strength, oxidation resistance, and hot corrosion resistance that can not be obtained from other alloys. For example, INCONEL alloy MA 754 has been considered as one of the ODS alloys with greater potential in the next generation advanced gas-turbine hot section components such as turbine vanes and combustor liners. In such applications, the ODS alloys are typically used to fabricate LAMILLOY sheets. As is known in the art, LAMILLOY is a multilayered porous material designed for cooled airframe and propulsion system components. It features a labyrinth of holes and passages in a laminated assembly. LAMILLOY is produced by photochemical machining an array of pedestals and holes in two or more layers of sheet material and subsequently diffusion bonding the layers into the laminated sheet configuration.

One particular use of MA 754 LAMILLOY material is in the construction of a combustor outer liner 10 for a gas turbine engine, as illustrated in FIG. 1. The combustor liner 10 is formed by roll forming two LAMILLOY sheets into half cylinders (or conic sections) 12 and 14, brazing the half cylinders 12 and 14 together at two lap joints 16 and 18, and then expansion forming the brazed detail 10 into the required design dimension, as indicated by the dashed line 20 in FIG. 2.

The MA754 LAMILLOY material 12 and 14 is preferably joined by brazing lap joints 16 and 18 rather than welding the two half cylinders 12 and 14 together at butt joints, because welding processes result in melting of the base material. Welding is unacceptable in MA754 LAMILLOY material due to agglomeration of the oxide dispersoids in the melted region resulting in drastic reductions in high temperature strength and environmental resistance.

The joining of two MA754 LAMILLOY sheets is accomplished by brazing, which is performed at a temperature below the melting point of the base material. The brazing process requires a lap joint (overlapping ends of the material to be brazed) instead of the butt joint normally used in welding. Therefore, the two half-cylinders 12, 14 are configured with the two lap joints 16, 18 which are brazed to form a permanent joint.

As shown in FIG. 2, the combustor liner 10 initially has a flat-sided configuration; however, the design requirements call for the sides to exhibit the curved configuration indicated by the dashed lines 20. In order to achieve the configuration 20, the workpiece 10 is placed onto a radial expander 22 (see FIG. 3), which will exert radial forces upon the workpiece 10 until it assumes the configuration 20. As is known in the art, the expander 22 includes a plurality of jaws 24 which may be moved in a radial direction under, hydraulic pressure.

Referring to FIG. 4A, a top plan view of the lap joint 16, 18 is shown. When the expander 22 is operated, a biaxial tension state of stresses is produced in the directions shown by the arrows in FIG. 4C. Because the half cylinders 12, 14 lie in different planes in the area of the lap joint 16, 18, the braze joint plane 26 rotates through an angle 28 (see FIG. 4B), which can be as much as 30 degrees relative to the stress axis.

This joint rotation results in loading the braze joints 16, 18 in combination of shear, bending and direct tensile stresses. Stress analysis confirms that high stress concentrations exist in the LAMILLOY near the lap joints 16, 18 during expansion forming. As an illustrative example, a combustor liner 10 was formed from two halves 12, 14 of rolled MA 754 LAMILLOY. Two brazed lap joints 16, 18 in the liner 10, featured overlap dimensions of 0.250 inch wide and 6.750 inches in length. During expansion forming of this combustor liner 10, the LAMILLOY material failed in a ductile manner due to strain localization near one of the brazed lap joints 16, 18 with less than 2% bulk diametral expansion. The design deformation objective for this application was 4.5% diametral expansion.

A need exists for a method and apparatus that will allow expansion forming of a workpiece by minimizing the concentration of stresses in the workpiece, particularly stresses related to joint rotation out of the plane of the stress axis. The present invention is directed toward meeting this need.

SUMMARY OF THE INVENTION

The present invention generally relates to an external cylindrical or conic section shaped fixture which is tightly fit around the same shaped workpiece prior to expansion forming to a final dimension. During expansion forming, the external fixture is also deformed and is therefore designed for one-time use. The external cylindrical or conic section shaped fixture of the present invention is particularly useful for expansion forming of workpieces which contain brazed lap joints. The external fixture restrains out-of-plane joint rotation and, reduces the stress concentrations existing near the lap-joints. Additionally, the external fixture provides additional load carrying capability to allow better load distribution during expansion forming. No change is required to the expansion forming machinery or the inner expander dies (jaws) with use of the present invention. Because the external fixture fits tightly over the workpiece, applying a compressive force when the inner expander jaws expand during the forming process, the bending moment on the brazed lap joints is significantly reduced.

In one form of the invention, a method for expansion forming a workpiece is disclosed, comprising the steps of a) providing an expansion forming device; b) providing an external fixture; c) fitting the external fixture around the workpiece; d) fitting the workpiece and external fixture assembly around the expansion forming device, such that the workpiece is positioned between the expansion forming device and the external fixture; e) expanding the expansion forming device such that the workpiece and the external fixture are deformed; and f) removing the external fixture from the workpiece after step (e).

in another form of the invention, a method for expansion forming a workpiece is disclosed, comprising the steps of a) providing an expansion forming device; b) providing a fixture; c) coupling the workpiece to the expansion forming device; d) coupling the fixture to the workpiece; e) expanding the expansion forming device such that both the workpiece and the fixture are deformed; f) removing the fixture from the workpiece after step (e).

DETAILED DESCRIPTION OF THE PREFERRED EMBODIMENTS

Figure 1:
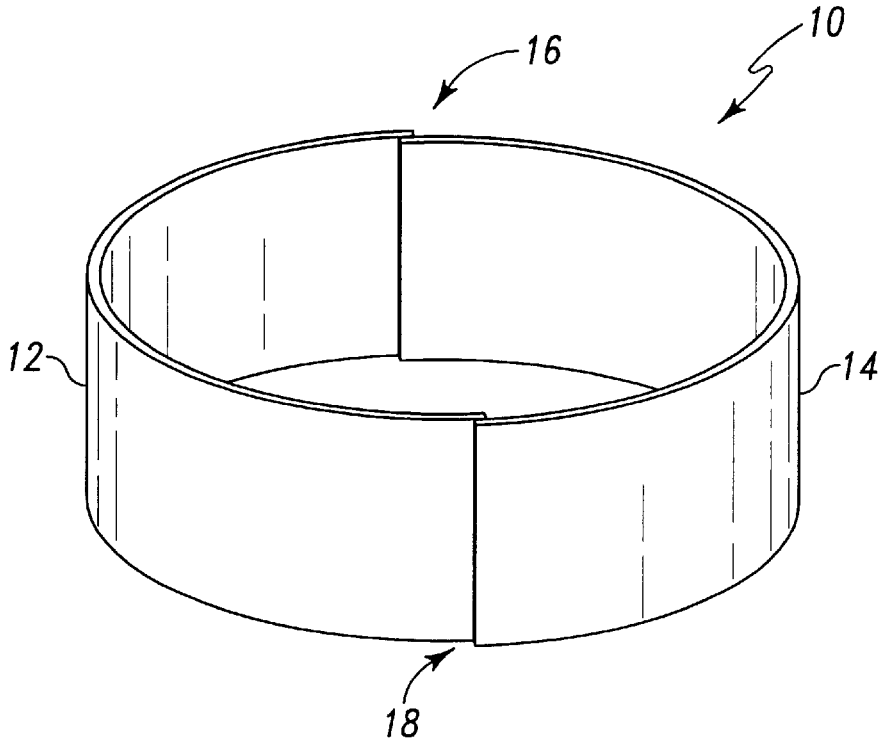
FIG. 1 is a perspective view of a cylindrical workpiece having two brazed lap joints.
Figure 2:
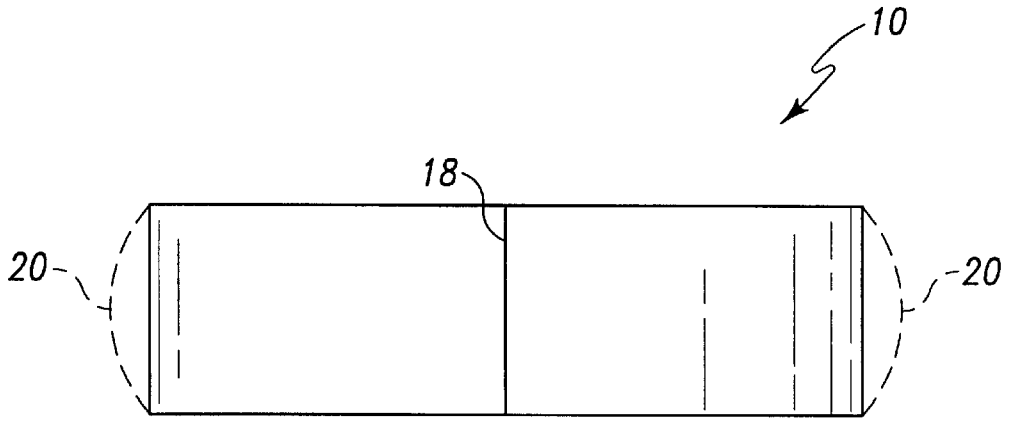
FIG. 2 is a side elevation view of the workpiece of FIG. 1, illustrating the dimensions to which the workpiece is to be expanded.
Figure 3:
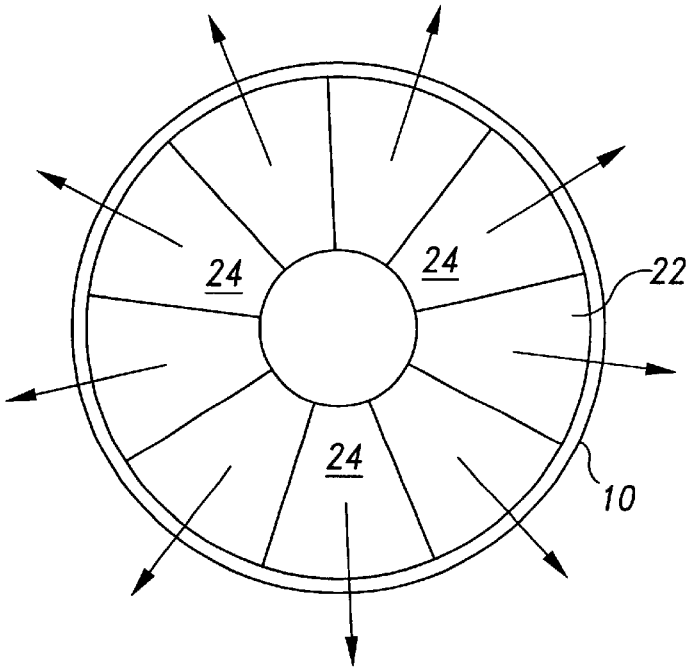
FIG. 3 is a plan view of the workpiece of FIG. 1 being formed with a radial expander.
Figure 4A:
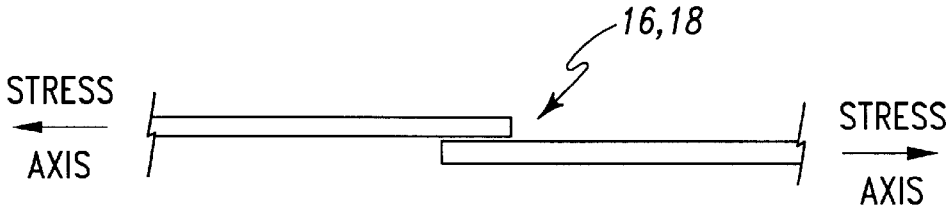
FIGS. 4A–C illustrate the out-of-plane rotation which occurs at a lap joint during expansion forming.
Figure 4B:
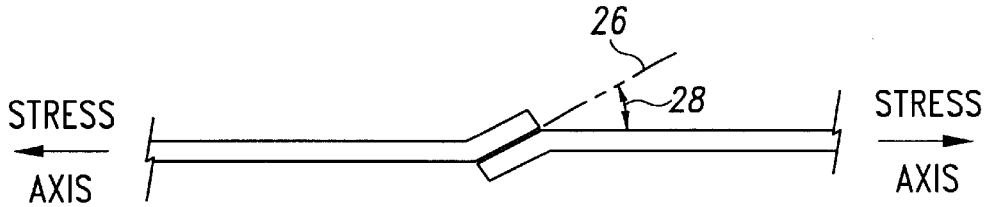
Figure 4C:
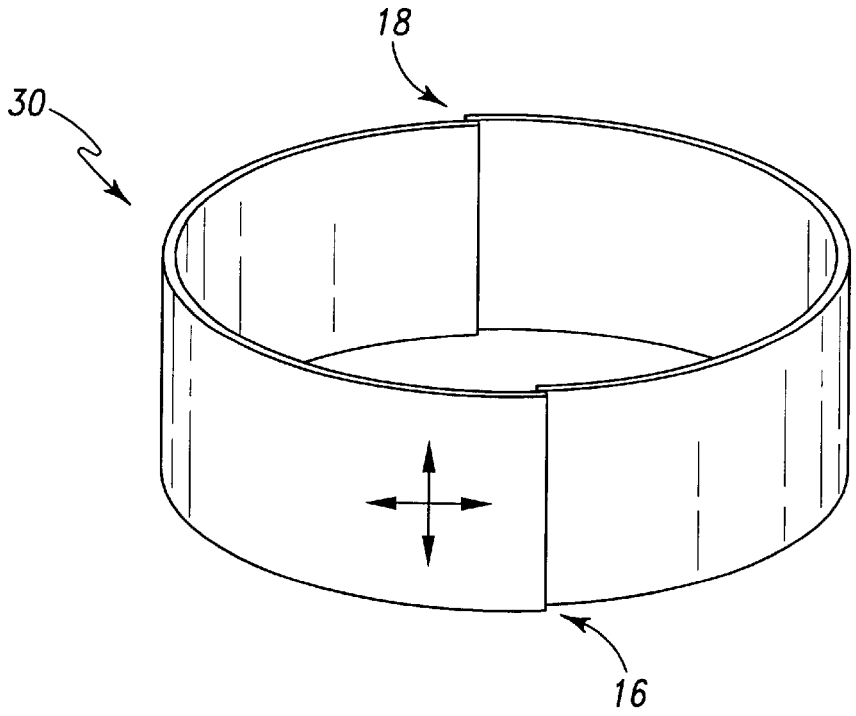

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 5:
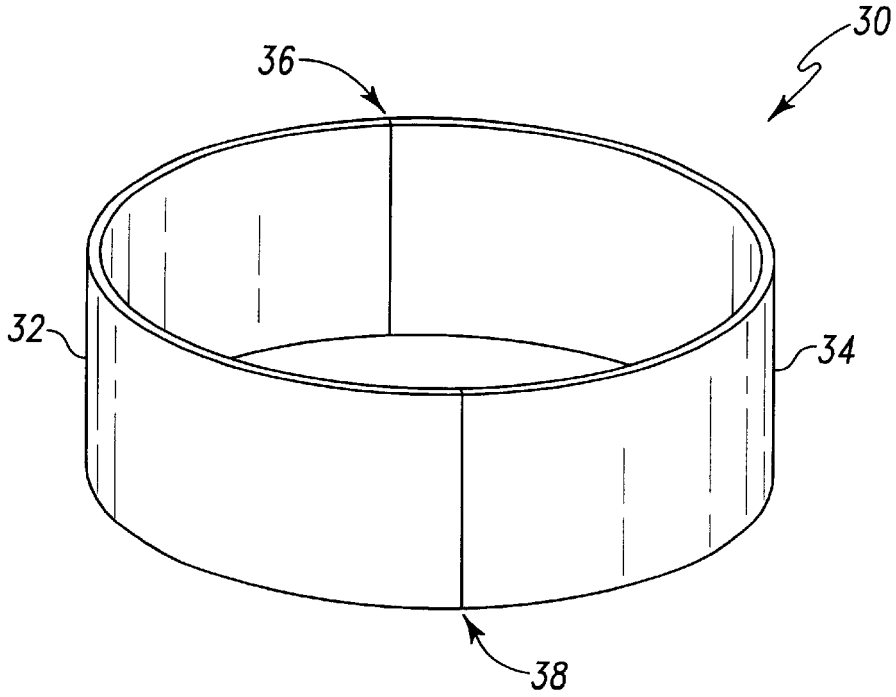
FIG. 5 is a perspective view of a preferred embodiment external fixture of the present invention.
Figure 6:
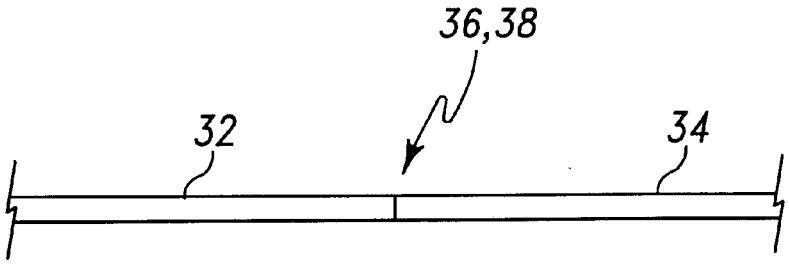
FIG. 6 is a top plan view of a weld butt joint of the fixture of FIG. 5.

In order to restrict joint bending and out-of-plane rotation experienced by the brazed lap joints 16, 18 during the prior art expansion forming process, the present invention provides an external fixturing cylinder or conic section 30, as illustrated in FIG. 5. In a preferred embodiment, the external fixture 30 is made from L605 nickel-based alloy and is formed from two half cylinders or conic sections 32 and 34 that are butt welded at their joints. The preferred embodiment material for the fixture 30 is 3–4 times stronger at room temperature than the LAMILLOY sheet from which the combustor liner 10 is fabricated. Typically, the material forming the fixture 30 is approximately 0.100 inch thick. Because L605 is a highly weldable material, the external fixture is fabricated by butt welding the half cylinders 32, 34 at 36, 38. As shown in FIG. 6, the butt welds 36, 38 allow the material of the half cylinders 32, 34 to form a continuous, true cylinder.

Figure 7:
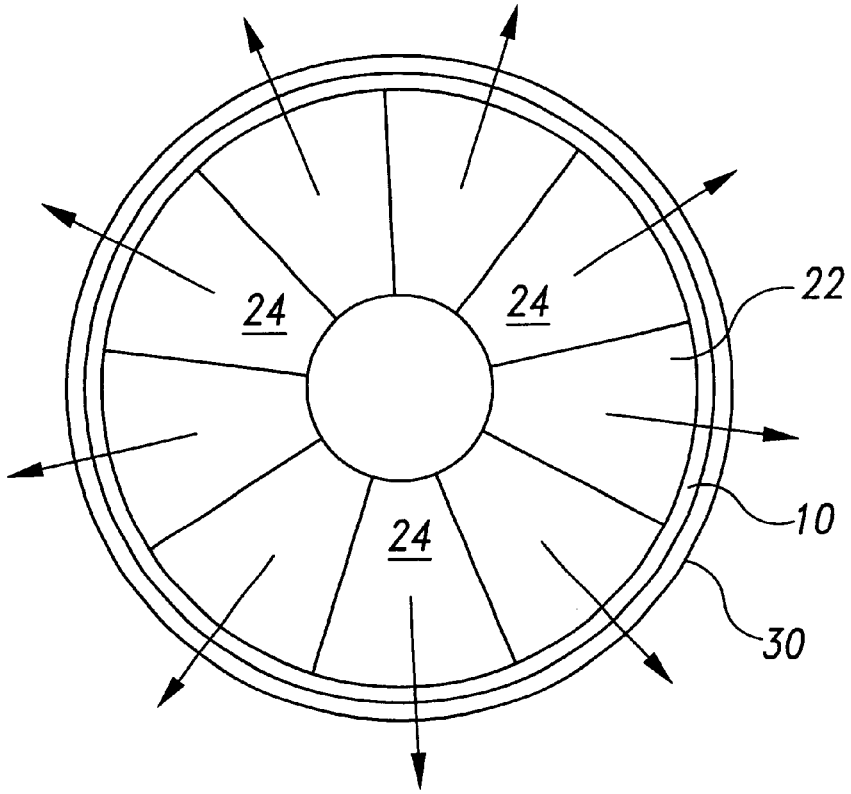
FIG. 7 is a top plan view of the workpiece of FIG. 1 and the fixture of FIG. 5 in use with a radial expander.

As illustrated in FIG. 7, after the external fixture 30 is first fit around the combustor liner 10, the combustor liner 10 is then placed upon the radial expander 22. The fixture 30 preferably has substantially the same inner diameter as the outer diameter of the combustor liner 10. The fixture 30 is therefore preferably heated (for example, to 500° F.) in order to slightly expand its diameter so that it may be fit over the combustor liner 10. Upon cooling to room temperature, the fixture 30 shrinks to form a tight fit over the combustor liner 10.

Prior to fitting the fixture 30 over the combustor liner 10, the outer surface of the combustor liner 10 and/or the inner surface of the fixture 30 are preferably coated with a layer of anti-bonding material in order to prevent bonding between the combustor liner 10 and the fixture 30 during either the expansion forming process or in-process annealing and to facilitate fixture 30 removal after forming. In the preferred embodiment, a fine ceramic powder, such as alumina powder in liquid form, is used for this purpose and is available under the brand STOP-OFF.

The combustor liner 10/fixture 30 combination then undergoes several expansion forming steps at room temperature. Each forming cycle is followed by a high temperature annealing process to relieve stresses within the materials. After each annealing, further expansion forming is performed at room temperature, followed by another annealing step, etc.

Because the weld joints in the fixture 30 are butt joints, they do not experience any out-of-plane rotation during the expansion forming process. Furthermore, because the fixture 30 applies compressive stresses to the combustor liner 10 during the expansion forming process, the brazed lap joints 16, 18 of the combustor liner 10 are held in-plane between the expansion forming jaws 24 and the fixture 30, which opposes any out-of-plate rotation of these joints 16, 18. This significantly reduces the stresses existing near the lap joints 16, 18. Furthermore, the fixture 30 provides for more uniform load distribution around the combustor liner 10 during the forming process.

Once the combustor liner 10 has been expansion formed to its final design dimensions, the fixture 30 is cut off and removed therefrom. Because the fixture 30 deforms (yields) during the expansion forming process and is cut off of the combustor liner 10 once expansion forming has been completed, the fixture 30 is not a multiple-use fixture.

It will be appreciated by those having ordinary skill in the art that the external fixture 30 of the present invention provides support and strength to a somewhat fragile workpiece during the expansion forming process and is particularly useful in preventing out-of-plane rotation of lap joints in the workpiece during the expansion forming process. The fixture 30 is relatively inexpensive to manufacture and use, and greatly reduces the failure rate when expansion forming workpieces having difficult geometries.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the materials specified herein for the construction of the workpiece and the fixture are only a preferred embodiment. Those having ordinary skill in the art will recognize that any materials having acceptable physical properties may be used. Furthermore, the present invention will find application with a wide variety of workpieces, and is not limited solely to use with the preferred embodiment combustor liner.

What is claimed:

1. A method for expansion forming a workpiece, comprising the steps of:

a) providing an expansion forming device wherein the expansion forming device comprises a plurality of radially-expanding jaws;

b) fitting the workpiece around the expansion forming device;

c) providing an external fixture;

d) fitting the external fixture around the workpiece, such that the workpiece is positioned between the expansion forming device and the external fixture;

e) expanding the expansion forming device such that the workpiece and the external fixture are deformed; and f) removing the external fixture from the workpiece after step (e).

2. The method of claim 1, wherein step (d) further comprises:

d.1) applying an anti-bonding material to the workpiece; and d.2) fitting the external fixture around the workpiece, such that the workpiece is positioned between the expansion forming device and the external fixture.

3. The method of claim 2, wherein step (d.1) comprises applying a powdered ceramic material to the workpiece.

4. The method of claim 1, wherein step (d) further comprises:

d.1) applying an anti-bonding material to the workpiece;

d.2) heating the external fixture;

d.3) fitting the external fixture around the workpiece, such that the workpiece is positioned between the expansion forming device and the external fixture;

d.4) cooling the external fixture.

5. The method of claim 1, wherein step (e) further comprises:

e.1) expanding the expansion forming device such that the workpiece and the external fixture are deformed;

e.2) annealing the workpiece and the external fixture.

6. The method of claim 1, wherein step (f) comprises cutting the external fixture off of the workpiece.

7. A method for expansion forming a workpiece, comprising the steps of:

a) providing an expansion forming device;

b) fitting the workpiece around the expansion forming device;

c) providing a cylindrical external fixture formed from two half-cylinders butt welded together;

d) fitting the external fixture around the workpiece, such that the workpiece is positioned between the expansion forming device and the external fixture;

e) expanding the expansion forming device such that the workpiece and the external fixture are deformed; and f) removing the external fixture from the workpiece after step (e).

8. A method for expansion forming a workpiece, comprising the steps of:

a) providing an expansion forming device;

b) providing a cylindrical external fixture formed from two half-cylinders butt welded together;

c) coupling the workpiece to the expansion forming device;

d) coupling the fixture to the workpiece;

e) expanding the expansion forming device such that both the workpiece and the fixture are deformed;

f) removing the fixture from the workpiece after step (e).

9. A method for expansion forming a workpiece, comprising the steps of:

a) providing an expansion forming device wherein the expansion forming device comprises a plurality of radially-expanding jaws;

b) providing a fixture;

c) coupling the workpiece to the expansion forming device;

d) coupling the fixture to the workpiece;

e) expanding the expansion forming device such that both the workpiece and the fixture are deformed;

f) removing the fixture from the workpiece after step (e).

10. The method of claim 9, wherein step (c) comprises fitting the workpiece around the expansion forming device.

11. The method of claim 9, wherein step (d) comprises fitting the fixture around the workpiece, such that the workpiece is positioned between the expansion forming device and the fixture.

12. The method of claim 9, wherein step (d) further comprises:

d.1) applying an anti-bonding material to the workpiece; and d.2) coupling the fixture to the workpiece.

13. The method of claim 12, wherein step (d.1) comprises applying a powdered ceramic material to the workpiece.

14. The method of claim 9, wherein step (d) further comprises:

d.1) applying an anti-bonding material to the workpiece; and d.2) heating the fixture;

d.3) fitting the fixture around the workpiece, such that the workpiece is positioned between the expansion forming device and the fixture; and d.4) cooling the fixture.

15. The method of claim 9, wherein step (e) further comprises:

e.1) expanding the expansion forming device such that both the workpiece and the fixture are deformed; and e.2) annealing the workpiece and the fixture.

16. The method of claim 9, wherein step (f) comprises cutting the fixture off of the workpiece.

17. A method for expansion forming a workpiece, comprising the steps of:

a) providing an expansion forming device, wherein the expansion forming device comprises a plurality of radially-expanding jaws;

b) providing an external fixture;

c) fitting the external fixture around the workpiece;

d) fitting the workpiece and external fixture assembly around the expansion forming device, such that the workpiece is positioned between the expansion forming device and the external fixture;

e) expanding the expansion forming device such that the workpiece and the external fixture are deformed; and f) removing the external fixture from the workpiece after step (e).

* * * * *